United States Patent [19]

Welch

[11] 4,422,908

[45] Dec. 27, 1983

[54] ZINC PLATING

[75] Inventor: Charles W. Welch, New Castle, Del.

[73] Assignee: E. I. Du Pont de Nemours & Co., Wilmington, Del.

[21] Appl. No.: 324,116

[22] Filed: Nov. 23, 1981

[51] Int. Cl.[3] ..... C25D 3/22

[52] U.S. Cl. ..... 204/55 R

[58] Field of Search ..... 204/55 R

[56] References Cited

U.S. PATENT DOCUMENTS

| | | | |
|---|---|---|---|
| 3,778,359 | 12/1973 | Popescu | 204/55 R |
| 3,855,085 | 12/1974 | Rushmere | 204/55 R |
| 4,014,761 | 3/1977 | Passal | 209/55 R |

*Primary Examiner*—Howard S. Williams

[57] ABSTRACT

A process of plating zinc is disclosed using a plating solution containing from 20 to 35 grams per liter of zinc ions; from 55 to 150 grams per liter of sulfamate ions; from 15 to 30 grams per liter of boric acid; from 15 to 45 grams per liter of sodium chloride or potassium chloride; from 0.6 to 3.0 grams per liter of an alkali metal benzoate, cinnamate, nicotinate, or 2-furylacrylate; from 0.5 to 1.1 grams per liter of a sulfonated fixed oil such as sulfonated caster oil, from 0.1 to 0.4 gram per liter of benzalacetone, furfuryl acetone, furfuryl crotonaldehyde or furfuryl acetonylacetone; and from 1.0 to 15 grams per liter of a polyether surfactant while maintaining the pH of the solution at from 4.0 to 5.5.

16 Claims, No Drawings

ZINC PLATING

BACKGROUND OF THE INVENTION

1. Field of the Invention

The present invention relates to a plating solution and process of using such solution to electroplate zinc on a metal substrate.

2. Prior Art

U.S. Pat. No. 3,855,085 discloses a process of electroplating metal substrates with zinc using an electroplating bath containing 30 to 60 grams per liter zinc metal preferably as zinc chloride, from 150 to 190 grams per liter chloride ion with the major portion of the chloride ion not derived from zinc chloride added in the form of ammonium chloride, from 0.05 to 20 grams per liter of a polyoxyethylene compound, from 0.05 to 2 grams per liter of a ketone, and from 0.05 to 20 grams per liter of a carboxylic acid.

U.S. Pat. No. 4,014,761 discloses a process of electroplating metal substrates with zinc using an electroplating bath containing a zinc salt, boric acid, optionally sodium chloride, a polyether surfactant, an aromatic carbonyl compound and sulfonated castor oil, in the absence of complexing or chelating agent of an organic nature.

British Pat. No. 1,499,782 discloses a process of electroplating metal substrates with zinc using an electroplating bath containing from 100 to 200 grams per liter of zinc sulphamate, from 25 to 40 grams per liter of sodium chloride, from 20 to 35 grams per liter of boric acid, from 1 to 30 grams per liter of a polyether surfactant and from 0.025 to 1 gram per liter of an aromatic carbonyl compound such as benzalacetone.

SUMMARY OF THE INVENTION

The present invention relates to an aqueous zinc metal electroplating bath of the type containing zinc sulfamate, a source of chloride ions, boric acid and surfactants wherein an organic salt of an alkali metal and an organic acid complexing agent selected from the group consisting of benzoic acid, cinnamic acid, nicotinic acid and 2-furylacrylic acid is added to the bath.

DETAILED DESCRIPTION

It has been found that by incorporating alkali metal salts of certain organic acids in a specific type of zinc sulfamate based aqueous zinc electroplating baths that the bright plating current density range is considerably extended over that obtained when such salt is omitted.

The operating pH of the electroplating baths of the present invention is 4.0 to 5.5 with 4.6 being preferred. Below pH 4.0 undesirable dissolution of the zinc anodes begins to occur even without electrolysis, and at a pH much above 5.5 precipitation of zinc salts can occur.

The zinc ions concentration in the electrolytic plating bath generally will be from 20 to 35 grams per liter (g/l) with 26 g/l being the preferred value. Below 20 g/l zinc ion concentration cathode efficiency begins to fall off and dull deposits begin to occur at current densitites above 80 amperes per square foot (80 a/ft$^2$) or 8.6 amperes per square decimeter (86 a/dm$^2$). Above 35 g/l zinc ion concentration dullness begins to occur at low current densities.

The amount of sulfamate ion present in the electrolytic plating bath generally will be from 55 to 150 g/l, with about 90 g/l being preferred.

The amount of boric acid present in the electrolytic plating bath generally will be from 15 to 30 g/l, with about 25 g/l being preferred.

The chloride ions present generally will be in the form of a salt of any of zinc, ammonia, sodium or potassium. Sodium chloride and potassium chloride are the preferred salts. Generally from 15 to 45 g/l of such salt will be present, with about 30 g/l being preferred.

Generally the electrolytic plating bath will contain from 0.6 to 3.0 g/l of an alkali metal salt of any of benzoic acid, cinnamic acid, nicotinic acid or 2-furylacrylic acid. Sodium and potassium are the preferred alkali metals for this use. Of these organic salts, sodium benzoate is preferred. Preferably the electrolytic plating bath contains about 2 g/l of one of these organic salts.

Generally the electrolytic plating bath will contain from 0.5 to 1.1 g/l of a sulfonated fixed oil. The preferred sulfonated fixed oil is sulfonated castor oil such as found in Turkey Red Oil. The preferred amount of sulfonated fixed oil in the electrolytic plating bath is 0.9 g/l.

Generally the electrolytic plating bath will contain from 0.1 to 0.4 g/l of an aromatic carbonyl compound. Suitable aromatic carbonyl compounds are benzalacetone, furfuryl acetone, furfuryl crotonaldehyde, and furfuryl acetonylacetone. The preferred aromatic carbonyl compound is benzalacetone. Preferably about 0.2 g/l of the aromatic carbonyl compound is present in the electrolytic plating bath.

Generally the electrolytic plating bath will contain from 1.0 to 15 g/l of a polyether surfactant, preferably about 3.3 g/l. Preferably the polyether surfactant has a molecular weight of from 700 to 2000. The nonionic polyoxyethylene compounds are the preferred polyether surfactants.

Generally the electroplating will be done at ambient temperatures such as 15° to 40° C.

EXAMPLE

An aqueous bath is prepared which contains 4.36 oz/gal (32.65 g/l) zinc ions, 12.64 oz/gal (94.66 g/l) sulfamate ions, 3.30 oz/gal (24.6 g/l) boric acid, 4.00 oz/gal (29.8 g/l) sodium chloride, 2 fluid oz/gal of Starter Brightener, and 1 fluid oz/gal of Brightener #2, and has a pH of 4.65. The Starter Brightener contained 13.0% of a nonionic polyoxyethylene surfactant of the formula

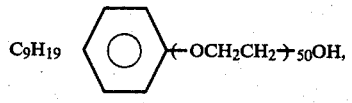

14.0% sodium benzoate, 3.5% Turkey Red Oil and the balance water. Brightener #2 contained 4.5% benzalacetone, 65.0% propylene glycol, 2.5% of a nonionic surfactant of the formula

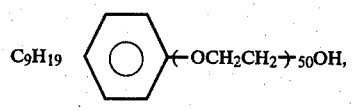

2.5% sodium benzoate, 0.5% Turkey Red Oil and the balance water. A Hull Cell containing 267 ml of the above electroplating solution is used to plate a steel cathode panel at 2 amperes for 5 minutes. The panel showed the following characteristics:

| | | |
|---|---|---|
| 0–1.5 a/ft$^2$ | (0–0.16 a/dm$^2$) | faint haze |
| 1.5–98 a/ft$^2$ | (0.16–10.5 a/dm$^2$) | bright |
| 98–100 a/ft$^2$ | (10.5–10.8 a/dm$^2$) | light burn |

When a panel was plated in a Hull Cell for 5 minutes at 2 amperes using a bath of the same composition as above but with no sodium benzoate present, the panel showed the following inferior deposit characteristics:

| | | |
|---|---|---|
| 0–3 a/ft$^2$ | (0–0.3 a/dm$^2$) | haze |
| 3–86 a/ft$^2$ | (0.3–9.3 a/dm$^2$) | bright |
| 86–98 a/ft$^2$ | (9.3–10.5 a/dm$^2$) | faint blush |
| 98–100 a/ft$^2$ | (10.5–10.8 a/dm$^2$) | light burn |

I claim:

1. A process for producing zinc electrodeposits which comprises passing current from a zinc anode to a metal cathode wherein the current is passed through an acidic aqueous bath having a pH of from about 4.0 to about 5.5, containing from 20 to 35 grams per liter of zinc ions; from 55 to 155 grams per liter of sulfamate ions; from 15 to 30 grams per liter of boric acid; from 15 to 45 grams per liter of sodium chloride or potassium chloride; from 0.6 to 3.0 grams per liter of an organic salt which is an alkali metal salt of a carboxylic acid complexing agent; from 0.1 to 0.4 grams per liter of aromatic carbonyl compound, from 0.5 to 1.1 grams per liter of a sulfonated fixed oil, and from 1.0 to 15 grams per liter of a polyether surfactant.

2. The process of claim 1 wherein the organic salt is an alkali metal benzoate, cinnamate, nicotinate, or 2-furylacrylate.

3. The process of claim 2 wherein the aromatic carbonyl compound is benzalacetone, furfuryl acetone furfuryl crotonaldehyde or furfuryl acetonylacetone.

4. The process of claim 3 wherein the sulfonated fixed oil is sulfonated castor oil.

5. The process of claim 4 wherein the aromatic carbonyl compound is benzylacetone.

6. The process of claim 5 wherein the polyether surfactant has a molecular weight of from 700 to 2000.

7. The process of claim 6 wherein the polyether surfactant is a polyoxyethylene.

8. The process of claim 7 wherein the organic salt is sodium benzoate.

9. The process of claim 8 wherein the bath contains about 26 grams per liter of zinc ions, about 90 grams per liter of sulfamate ions, about 25 grams per liter of boric acid, about 30 grams per liter of sodium chloride, 2 grams per liter of sodium benzoate, about 0.9 gram per liter of sulfonated castor oil, about 0.2 gram per liter of benzalacetone, about 3.3 grams per liter of polyoxyethylene surfactant and has a pH of about 4.6.

10. An acidic aqueous plating solution having a pH of from about 4.0 to about 5.5, comprising from 20 to 35 grams per liter of zinc ions; from 55 to 155 grams per liter of sulfamate ions; from 15 to 30 grams per liter of boric acid; from 15 to 45 grams per liter of sodium chloride or potassium chloride; from 0.6 to 3.0 grams per liter of an organic salt which is an alkali metal benzoate, cinnamate, nicotinate or 2-furylacrylate; from 0.1 to 0.4 gram per liter of an aromatic carbonyl compound which is benzalacetone, furfuryl acetone, furfuryl crotonaldehyde or furfuryl acetonylacetone, from 0.5 to 1.1 grams per liter of a sulfonated fixed oil, and from 1.0 to 15 grams per liter of a polyether surfactant.

11. The solution of claim 10 wherein the sulfonated fixed oil is sulfonated castor oil.

12. The solution of claim 11 wherein the aromatic carbonyl compound is benzylacetone.

13. The solution of claim 12 wherein the polyether surfactant has a molecular weight of from 700 to 2000.

14. The solution of claim 13 wherein the polyether surfactant is a polyoxyethylene.

15. The solution of claim 14 wherein the organic salt is sodium benzoate.

16. The solution of claim 15 wherein the solution contains about 26 grams per liter of zinc ions, about 90 grams per liter of sulfamate ions, about 25 grams per liter of boric acid, about 30 grams per liter of sodium chloride, about 2 grams per liter of sodium benzoate, about 0.9 gram per liter of sulfonated castor oil, about 0.2 gram per liter of benzalacetone, about 3.3 grams per liter of polyoxyethylene surfactant and has a pH of about 4.6.

* * * * *